US009831553B2

(12) United States Patent
Liu et al.

(10) Patent No.: US 9,831,553 B2
(45) Date of Patent: Nov. 28, 2017

(54) MULTI-FREQUENCY ARRAY ANTENNA

(71) Applicant: Comba Telecom Systems (China) Ltd., Guangzhou (CN)

(72) Inventors: Peitao Liu, Guangzhou (CN); Feifei Jia, Guangzhou (CN); Shanqiu Sun, Guangzhou (CN)

(73) Assignee: Comba Telecom Systems (China) Ltd (CN)

( * ) Notice: Subject to any disclaimer, the term of this patent is extended or adjusted under 35 U.S.C. 154(b) by 90 days.

(21) Appl. No.: 14/442,975

(22) PCT Filed: Oct. 24, 2013

(86) PCT No.: PCT/CN2013/085858
§ 371 (c)(1),
(2) Date: May 14, 2015

(87) PCT Pub. No.: WO2014/082510
PCT Pub. Date: Jun. 5, 2014

(65) Prior Publication Data

US 2015/0288065 A1 Oct. 8, 2015

(30) Foreign Application Priority Data

Nov. 30, 2012 (CN) ..... 2012 1 0505081

(51) Int. Cl.
*H01Q 21/00* (2006.01)
*H01Q 5/20* (2015.01)
(Continued)

(52) U.S. Cl.
CPC ..... *H01Q 5/20* (2015.01); *H01Q 1/246* (2013.01); *H01Q 5/40* (2015.01); *H01Q 5/42* (2015.01);
(Continued)

(58) Field of Classification Search
CPC ..... H01Q 19/32; H01Q 3/18; H01Q 1/12; H01Q 1/1207; H01Q 21/28
(Continued)

(56) References Cited

U.S. PATENT DOCUMENTS 4,434,425 A 2/1984 Barbano
6,333,720 B1 12/2001 Gottl et al.
(Continued)

FOREIGN PATENT DOCUMENTS

CN 1886864 A 12/2006
CN 101425626 A 5/2009
(Continued)

OTHER PUBLICATIONS

Extended European Search Report for Application No. EP13858188 dated Oct. 19, 2015.
(Continued)

*Primary Examiner* — Dameon E Levi
*Assistant Examiner* — Collin Dawkins
(74) *Attorney, Agent, or Firm* — Lerner, David, Littenberg, Krumholz & Mentlik, LLP

(57) ABSTRACT

A multi-frequency array antenna, includes a reflective metal plate, a low-frequency radiation column element which is arranged on the reflective metal plate and operating in a first frequency band range, and a high-frequency radiation column element operating in a second frequency band range. The low-frequency radiation column element comprises several low-frequency radiation units arranged at an equal first distance in the axial direction of a first reference axis. The high-frequency radiation column element comprises several high-frequency radiation units arranged at an equal second distance in the axial direction of the first reference axis. The first distance is 2.5 times the second distance. At least one of the low-frequency radiation units is nested with
(Continued)

one high-frequency radiation unit locationally corresponding thereto, and at least one of the low-frequency radiation units is axially located between two adjacent high-frequency radiation units close to the low-frequency radiation unit.

17 Claims, 5 Drawing Sheets

(51) Int. Cl.

| | |
|---|---|
| ***H01Q 1/24*** | (2006.01) |
| ***H01Q 9/26*** | (2006.01) |
| ***H01Q 19/10*** | (2006.01) |
| ***H01Q 21/26*** | (2006.01) |
| ***H01Q 5/42*** | (2015.01) |
| ***H01Q 5/40*** | (2015.01) |

(52) U.S. Cl.
CPC ..... *H01Q 9/26* (2013.01); *H01Q 19/10* (2013.01); *H01Q 19/106* (2013.01); *H01Q 21/26* (2013.01)

(58) Field of Classification Search
USPC ..... 343/835, 779, 878, 718, 725, 797, 343/815–818
See application file for complete search history.

(56) References Cited

U.S. PATENT DOCUMENTS

2004/0252071 A1* 12/2004 Bisiules ..... H01P 5/103 343/797
2012/0280880 A1* 11/2012 Arvidsson ..... H01Q 1/246 343/810

FOREIGN PATENT DOCUMENTS

| | | | |
|---|---|---|---|
| CN | 102299398 | A | 12/2011 |
| CN | 102769174 | A | 11/2012 |
| CN | 102969575 | A | 3/2013 |
| EP | 2521218 | A2 | 11/2012 |

OTHER PUBLICATIONS

International Search Report for Application No. PCT/CN2013/085858 dated Feb. 20, 2014.

* cited by examiner

MULTI-FREQUENCY ARRAY ANTENNA

FIELD OF THE INVENTION

The present invention relates to the field of mobile communication, and in particular to a multi-frequency array antenna applicable for frequency bands of 2G, 3G and 4G.

DESCRIPTION OF THE PRIOR ART

Mobile communication is currently developing rapidly. In particular, 4G LTE mobile communication systems have been growing vigorously over recent years. At the same time, mobile communication operators have also intensified the effort to optimize 2G and 3G networks as much as possible to meet the demand for capacities and speed of communication systems. It is safe to say that 2G, 3G and 4G mobile communication systems will co-exist for a long time. As people have been paying increasingly high attention to electromagnetic radiation, the site selection and construction of new stations by operators often attract attention from and are resisted by residents living in the neighborhood. On the other hand, there is an urgent need for the expansion and reconstruction of stations by domestic and foreign operators, who, therefore, have more urgent needs for broadband antennas that can be compatible with 2G, 3G and 4G network frequency bands. For the conventional 2G/3G dual-frequency common antenna with the low-frequency band being 820-960 MHz and the high-frequency band being 1710-2170 MHz, the wavelength at the center frequency of the low-frequency band is 337 mm, while the wavelength at the center frequency of the high-frequency band is only 154.6 mm. The ratio of the two is 2.17 times. According to the prior art, therefore, the optimal setup is usually that the distance between low-frequency radiation units is 2 times of the distance between high-frequency radiation units.

Prior Art I: the US Patent Publication U.S. Pat. No. 4,434,425 published in 1984 with the applicant being GTE Products Corporation provides a radiation unit and proposes a solution that nests a high-frequency radiation unit within a low-frequency radiation unit, as shown in FIG. 1. Furthermore, the U.S. Pat. No. 6,333,720B1 filed by the German kathrein company in 2001 provides a multiband common base station antenna for mobile communication as shown in FIG. 2 in the patent publication. The Chinese Patent Publication No. CN101425626A with the applicant being Comba Telecom Systems (China) Co., Ltd. in 2007 also provides an array antenna formed by co-axially nested high and low frequencies as shown in FIG. 3. The above published patents easily realize a broadband, narrow cross-sectional multi-frequency common base station antenna with 2G/3G coaxial arrangement. The principle of implementation is based on the relationship that the center frequency of the working band of low-frequency radiation unit is close to 2 times of the center frequency of the working band of high-frequency radiation unit, the configuration that the low-frequency radiation units are nested with one high-frequency radiation unit is usually employed by simultaneously arranging a high-frequency radiation unit between two low-frequency radiation units. In the end, the distance between two neighboring low-frequency radiation units is 2 times of the distance between two neighboring high-frequency radiators.

Since what is needed by existing mobile communication systems is broadband, dual-frequency dual-polarized array antenna, the ratio of wavelengths corresponding to the center frequencies of the low-frequency band and the high-frequency band has reached a relationship greater than 2 times of frequency. For example: the working bands of 2G/3G/4G mobile communication systems are: the low-frequency band is 790-960 MHz and the high-frequency band is 1700-2700 MHz, the wavelength at the center frequency of the low-frequency band is 342 mm, while the wavelength at the center frequency of the high-frequency band is only 136.36 mm. The ratio of the two has reached 2.5 times. Along with the drastic increase of the bandwidth of high-frequency end (the bandwidth being about 45%), in particular, the highest frequency of 2700 MHz is more than 3.4 times of the low-frequency end of 790 MHz. Therefore, the relationship that the distance between low-frequency radiation units is 2 times of the distance between high-frequency units is no longer able to achieve the optimal radiation performance of the high/low frequency array antenna.

Prior Art II: to solve the above arraying problem of dual-broad frequency antenna, please refer to FIG. 4. In the Patent Application with the Publication No. CN102299398A, claim 1 is "a dual-band and dual-polarized antenna, comprising: a reflector, and a high-frequency radiator array and a low-frequency radiator array arranged on the same side of the reflector and comprised of two or more high-frequency radiators and low-frequency radiators, respectively, the high-frequency radiators and low-frequency radiators are coaxially arranged along the axis of the reflector, characterized in that two high-frequency radiators are arranged between neighboring low-frequency radiators, and each low-frequency radiator encases a high-frequency radiator"; in addition, claim 5 is that "every two neighboring high-frequency radiators are spaced at 106 mm, and every two neighboring low-frequency radiators are spaced at 318 mm." It can be seen from claim 1, together with FIG. 1 and FIG. 2, that the distance between low-frequency radiators is 3 times of the distance between high-frequency radiators. According to the above analysis, the wavelength at the center frequency of the high-frequency band is 2.5 times of that of the low-frequency band in the existing mobile communication bands. Apparently, such an arraying configuration is merely an improvement, which cannot fundamentally solve the arraying problem of existing dual-broad frequency antennas. Furthermore, it can be seen with reference to claim 5 that when the distance between high-frequency radiators is set to 106 mm, the distance between low-frequency radiators is 318 mm, the distance between low-frequency units is 1.02 times of the wavelength at the frequency of 960 MHz that is 312.5 mm. According to the array antenna theory, a distance between low-frequency radiation units that exceeds one times of the wavelength apparently has serious impact on the performance of low-frequency arrays. In particular, the gating lobe of high level will unavoidably occur in the electrical down-tilting process of the vertical face at the frequency of 960 MHz, leading to deteriorated radiation performance indices thereof.

DISCLOSURE OF THE INVENTION

Technical Problem

The object of embodiment of the present invention is to overcome the above drawbacks by providing a multi-frequency array antenna, looking for the layout relationship between the neighboring distance of low-frequency radiation units and the neighboring distance of high-frequency radiation units so as to realize the coaxial arraying of low-frequency radiation units and high-frequency radiation units so as to be compatible with signals of current 2G, 3G and 4G mobile communication networks.

Solution to the Problem

Technical Solution

The embodiment of the present invention is implemented with the following technical solution:

The multi-frequency array antenna according to the embodiment of the present invention comprises a metal reflector, a low-frequency radiation column element that is arranged on the metal reflector and operates in a first frequency band range, and a high-frequency radiation column element operating in a second frequency band range. The low-frequency radiation column element comprises several low-frequency radiation units arranged at an equal first distance in the axial direction of a first reference axis, the high-frequency radiation column element comprises several high-frequency radiation units arranged at an equal second distance in the axial direction of the first reference axis, wherein the first distance is 2.5 times of the second distance, at least one of the low-frequency radiation units is nested with one high-frequency radiation unit locationally corresponding thereto, and separately, at least one of the low-frequency radiation units is axially located between two neighboring high-frequency radiation units adjacent to the low-frequency radiation unit.

Preferably, each of the low-frequency radiation units with the axial positions on the first reference axis being an odd or even number is nested with one high-frequency radiation unit locationally corresponding thereto, and other low-frequency radiation units are scattered between two neighboring high-frequency radiation units axially adjacent to the low-frequency radiation units.

Preferably, both the low-frequency radiation units and the high-frequency radiation units comprise a radiation arm for radiating signals in their band ranges, and when projected orthographically to the orthographical projection plane of the metal reflector, there is no overlapping between all radiation arms of the low-frequency radiation units and radiation arms of the high-frequency radiation units.

Preferably, for the mutually nested low-frequency radiation units and high-frequency radiation units, their own radiation arms are in a relationship of central symmetry, and when projected orthographically to the orthographical projection plane of the metal reflector, the two's symmetry centers are overlapped.

Furthermore, the low-frequency radiation column element comprises two types of low-frequency radiation units having different radiation arm structures, wherein the first low-frequency radiation unit and the second low-frequency radiation unit are located at the odd numbered and even numbered positions in the axial direction, respectively. When projected orthographically to the orthographical projection plane of the metal reflector, the radiation arm of the first low-frequency radiation unit is of any ring shape, including rectangular and circular. When projected orthographically to the orthographical projection plane of the metal reflector, the radiation arm of the second low-frequency radiation unit is of a crossing shape with an orthogonal relationship.

Preferably, the first distance of the low-frequency radiation column element is 0.6-1.0 times of the wavelength corresponding to the center frequency of the first frequency band range, preferably 0.8 times. Similarly, the second distance of the high-frequency radiation column element is 0.6-1.0 times of the wavelength corresponding to the center frequency of the second frequency band range, preferably 0.8 times.

Preferably, the first frequency band range in which the low-frequency radiation column element operates is 790-960 MHz; and the second frequency band range in which the high-frequency radiation column element operates is 1700-2700 MHz. The value of the first distance is in the range of 262.5-287.5 mm, and the value of the second distance is in the range of 105-115 mm.

Preferably, the low-frequency radiation units and the high-frequency radiation units are all arranged on the first reference axis.

As disclosed by one example of the present invention, at least one of the low-frequency radiation units axially arranged between two neighboring high-frequency radiation units is fixed on a second reference axis, while the two high-frequency radiation units adjacent thereto are fixed on a third reference axis, and the second reference axis and the third reference axis are symmetric with respect to and parallel to the first reference axis. As disclosed by another example of the present invention, based on the above description, another low-frequency radiation units axially arranged between two neighboring high-frequency radiation units is fixed on the third reference axis, while the two high-frequency radiation units adjacent thereto are fixed on the second reference axis.

Advantageous Effect of the Invention

Advantageous Effect

Compared with the prior art, the technical effect of the present invention is not anticipatable:

First, in the present invention, with respect to the first distance between the low-frequency radiation units and the second distance between the high-frequency radiation units, an optimal setting is obtained by limiting the first distance to be 2.5 times of the second distance, which substantially arranges the low-frequency radiation column element and the high-frequency radiation column element on the same first reference axis, such that the electrical performance of signals in all band ranges is optimized, consequently it can be simultaneously compatible with mobile communication systems in the range of three operating bands of 2G, 3G and 4G. As a result, signal receiving and transmission can be performed for all of the current mobile communication systems, such as GSM, CDMA and LTE, with one set of multi-frequency array antenna, which solves the difficulty that has not been addressed and has obsesses those skilled in the art for many years.

Second, by defining that the low-frequency radiation column element employs two types of low-frequency radiation units with different structures, it can effectively avoid the phenomenon that their radiation arms are overlapped when projected orthographically to the orthographical projection plane of the metal reflector, thereby minimizing the signal interference between the low-frequency radiation column element and the high-frequency radiation column element and ensuring that the multiple relationship between the above two distances is more reliable.

Furthermore, by limiting that the first distance and the second distance are 0.6-1.0 times of their frequency band ranges, preferably 0.8 times, it further optimizes the entire arraying effect such that the electrical performance of the multi-frequency array antenna according to the present invention is optimized.

BRIEF DESCRIPTION OF THE DRAWINGS

Description of the Drawings

Figure 1:
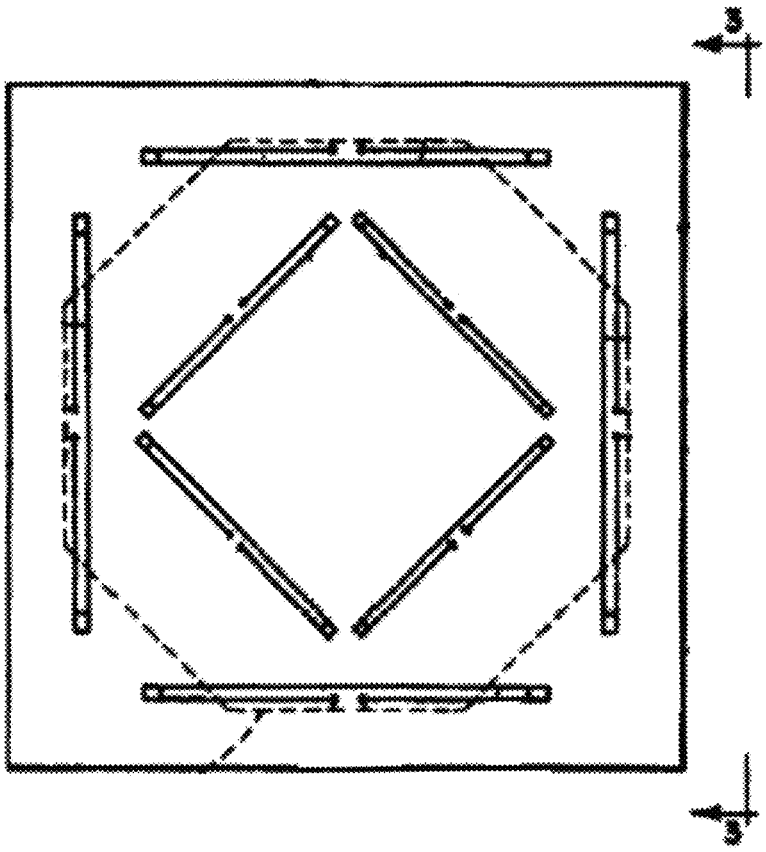
Fig. 1 (Prior Art)
Figure 2:
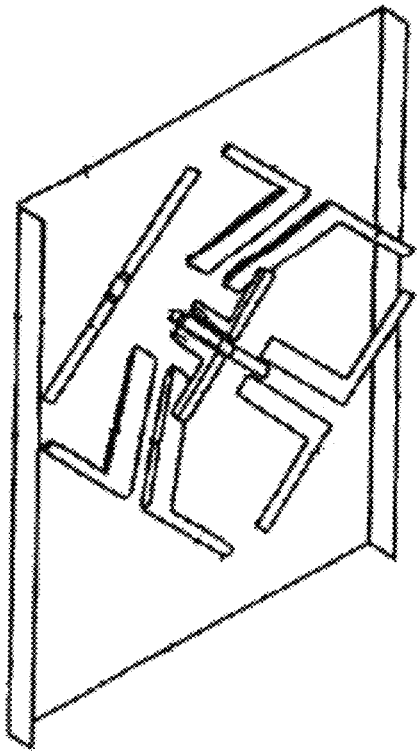
Fig. 2 (Prior Art)
Figure 3:
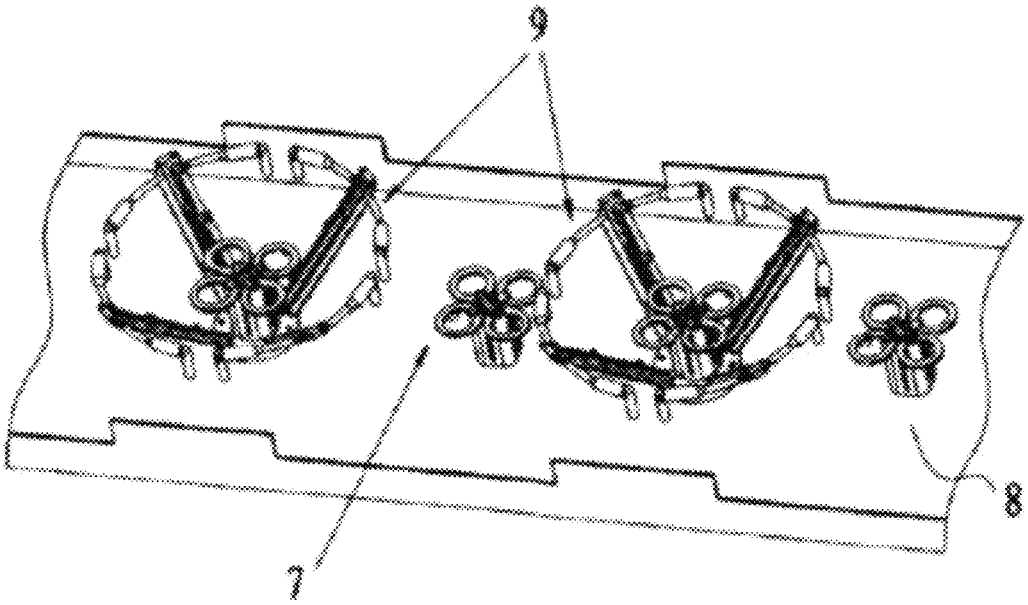
Figure 4:
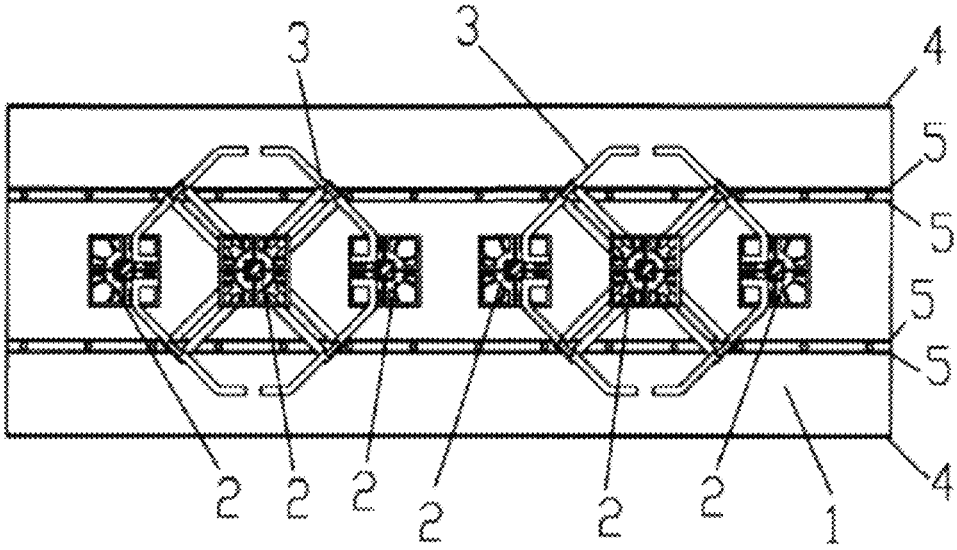
Figure 5:
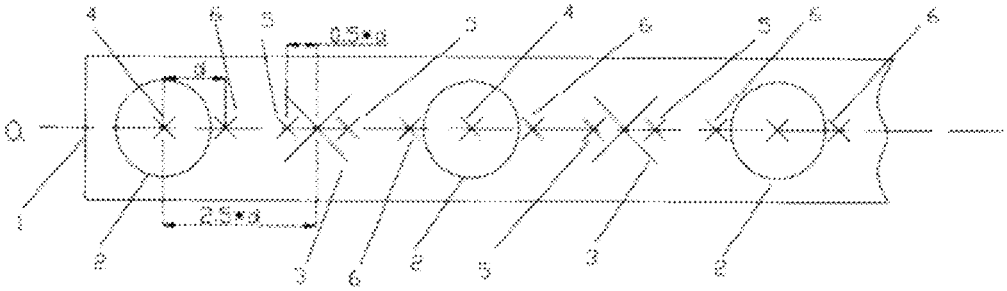
Figure 6:
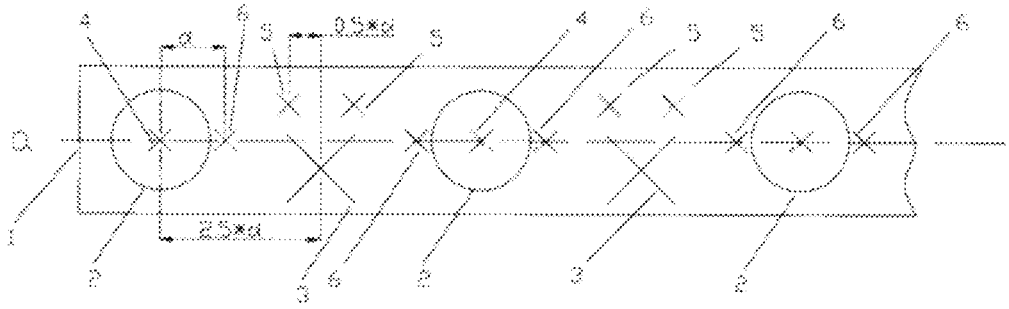
Figure 7:
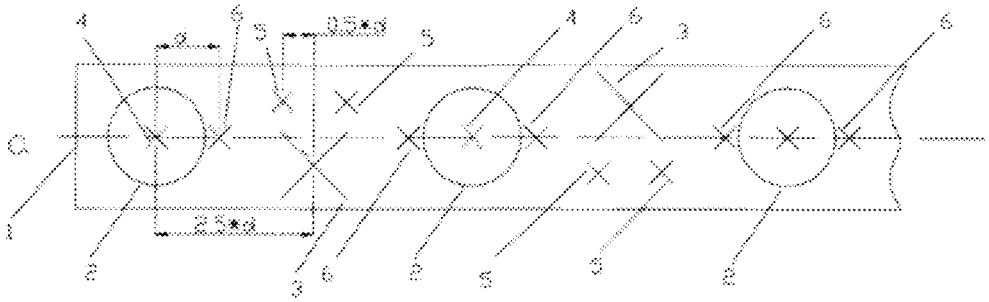
Figure 8:
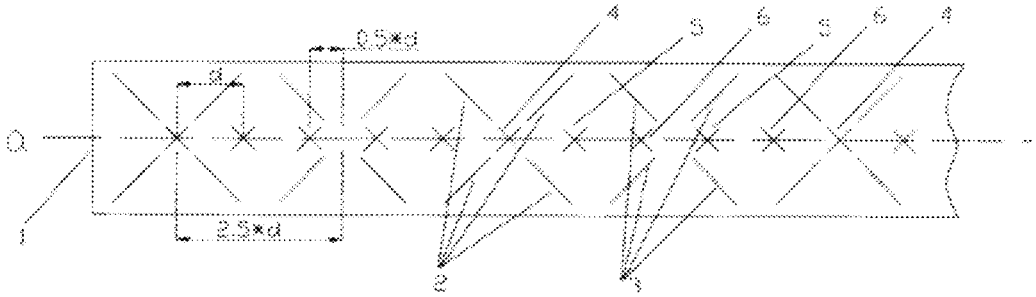
Figure 9:
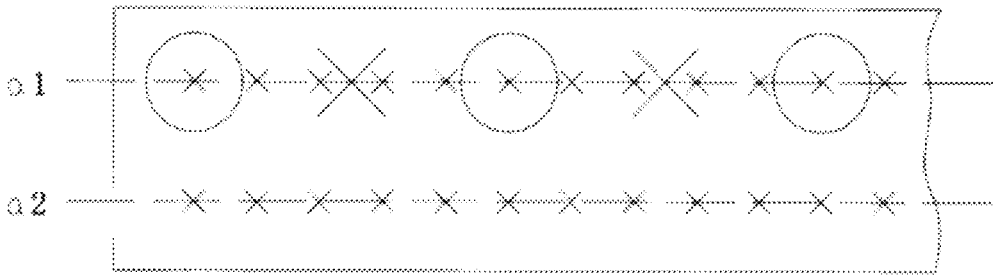
Figure 10:
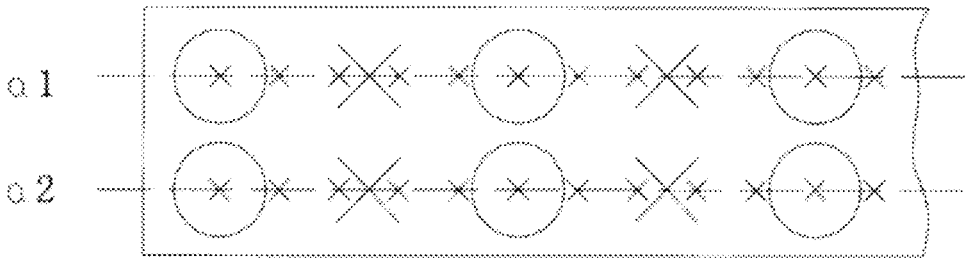
Figure 11:
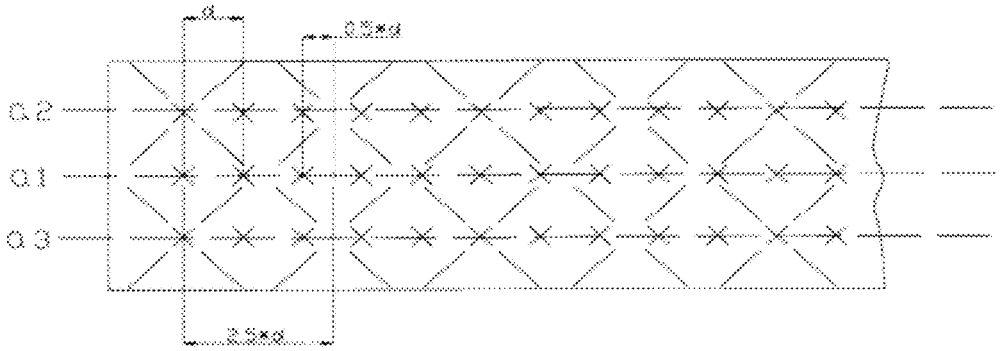

FIG. 1 illustrates the structure of a radiation unit according to the US Patent Publication U.S. Pat. No. 4,434,425;

FIG. 2 illustrates the structure of a radiation unit according to the US Patent Publication U.S. Pat. No. 6,333,720B1;

FIG. 3 illustrates a dual-frequency dual-polarized array antenna according to the Chinese Patent Publication No. N101425626A;

FIG. 4 illustrates a dual-frequency dual-polarized array antenna according to the Chinese Patent Publication No. CN102299398A;

FIG. 5 is an arraying schematic diagram of the multi-frequency array antenna according to Example 1 of the present invention with both low-frequency radiation units and high-frequency radiation units arranged on the same reference axis;

FIG. 6 and FIG. 7 are arraying schematic diagrams of the multi-frequency array antenna according to Example 2 and Example 3 of the present invention, respectively, with their low-frequency radiation units and high-frequency radiation units arranged on a plurality of reference axis, wherein FIG. 7 is an alternative based on FIG. 6;

FIG. 8 is an arraying schematic diagram of the multi-frequency array antenna according to Example 3 of the present invention, which employs low-frequency radiation units of a unified shape;

FIG. 9 is an arraying schematic diagram of the multi-frequency array antenna according to Example 4 of the present invention, which expands the high-frequency radiation column element based on the example disclosed in FIG. 5 such that the antenna operates in three frequency band ranges;

FIG. 10 is an arraying schematic diagram of the multi-frequency array antenna according to Example 5 of the present invention, which expands the high-frequency radiation column element and the low-frequency radiation column element based on the example disclosed in FIG. 5 such that the antenna operates in four frequency band ranges;

FIG. 11 is an arraying schematic diagram of the multi-frequency array antenna according to Example 6 of the present invention, which enables the antenna to operate in five frequency band ranges through more flexible expansion of the high-frequency radiation column element and the low-frequency radiation column element.

PREFERRED EMBODIMENTS TO IMPLEMENT THE PRESENT INVENTION

Preferred Embodiments of the Invention

Embodiments of the Invention

Detailed Description of Specific Embodiments

Examples of the present invention will be described in detail below with reference to the accompanying drawings.

In a mobile communication antenna, radiation column elements (comprising low-frequency radiation column element and high-frequency radiation column element) are used for radiating communicating signals, which are typically formed by arranging a plurality of radiation units in a single-column matrix on a metal reflector. For high-frequency signals, the high-frequency radiation column element is formed by arranging a plurality of high-frequency radiation units at an equal distance in the axial direction of the same reference axis, and for the ease of subsequent description, the distance is defined as the second distance. Correspondingly, the low-frequency radiation column element is formed by arranging a plurality of low-frequency radiation units at an equal distance in the axial direction of the same reference axis, and similarly, the distance is defined as the second distance, wherein the part of the radiation units for performing signal transmission and receiving is the radiation arm thereof, the radiation arm is usually located at the periphery of a radiation unit and has a variety of known structures. However, they all employ the central symmetric relationship, i.e. they typically consist of two pairs of symmetric radiators in the orthogonal form, each pair of symmetric radiators comprises two of the radiation arms, and radiation arms of common radiation units mostly form a ring shape, including rectangular and circular. Of course, they may also comprise other polygonal rings; alternatively, the radiation arm may also be designed to have a shape of horizontal elongation, and the same pair of symmetric radiators is substantially elongated longitudinally, such that the radiation units after orthogonal configuration appear to be a "cross". Generally speaking, radiation arms of different symmetric radiators do not have physical contact. Radiation units may be printed in 2 dimensions, or may have a 3-D structure. These fundamental concepts will be followed in the description of all examples of the present invention. When a radiation column element is installed on a metal reflector, it is projected orthographically to the direction of the reflector to form an orthographical projection plane. FIG. 5 to FIG. 11 of the present invention all use this orthographical projection plane for illustration so as to clearly disclose the layout relationship among different radiation column elements.

In all examples disclosed by the present invention, the low-frequency radiation column element and high-frequency radiation column element thereof all operate in different frequency band ranges, and the "low-frequency" of the low-frequency radiation column element herein indicates that it is lower than the frequency of the "high-frequency" of the high-frequency radiation column element. Preferably, the low-frequency radiation column element operates in the frequency band range of 790-960 MHz, which covers current 2G and 3G mobile communication frequency bands globally, while the high-frequency radiation column element operates in the frequency band range of 1700-2700 MHz, which covers current 4G mobile communication frequency bands globally, such as the LTE standard.

Please refer to FIG. 5. The multi-frequency array antenna according to Example 1 of the present invention arranges a low-frequency radiation column element and a high-frequency radiation column element coaxially along an imaginary first reference axis a on the metal reflector 1, thereby forming a set of dual frequency common antenna.

The high-frequency radiation column element is formed by 12 high-frequency radiation units (4, 5, 6) arranged sequentially at an equal second distance in the axial direction of the first reference axis a, all of the high-frequency radiation units are arranged on the first reference axis a, and arranged in the position sequence from left to right. For the ease of description, the second distance between the locationally neighboring high-frequency radiation units 4, 6, 5 is defined as d.

The low-frequency radiation column element is formed by 5 low-frequency radiation units (2, 3) arranged sequentially at an equal first distance in the axial direction of the first reference axis a, all of the low-frequency radiation units are arranged on the first reference axis a, and arranged in the position sequence from left to right, wherein given the above second distance d, the first distance between two axially neighboring low-frequency radiation units 2, 3 is limited to be 2.5 d.

To realize the above multiple relationship between the first distance and the second distance, according to the sequence from left to right, the low-frequency radiation unit 2 with the position being an odd number is nested with a high-frequency radiation unit 4 that appears to be locationally corresponding due to the multiple relationship. For example, the axial $1^{st}$, $3^{rd}$ and $5^{th}$ low-frequency radiation units are nested with the axial $1^{st}$, $6^{th}$ and $11^{th}$ high-frequency radiation units, respectively. If physical error is not considered, the realization of such a nesting relationship means that, on the orthographical projection plane, the symmetry center of the radiation arm of the low-frequency radiation unit 2 is overlapped with the symmetry center of the radiation arm of the high-frequency radiation unit 4. On the other hand, the low-frequency radiation unit 3 with the position being an even number is located axially between two neighboring high-frequency radiation units 5 due to the multiple relationship, and if physical error is not considered, it is theoretically located at the exact middle between two neighboring high-frequency radiation units 5. For example, the axial $2^{nd}$ and $4^{th}$ low-frequency radiation units are exactly located at the exact middle between the axial $3^{rd}$ and $4^{th}$, and $8^{th}$ and $9^{th}$ high-frequency radiation units 5, respectively. In such a way, if calculated according to the multiple relationship, the distance from the low-frequency radiation unit 3 with the position being an even number to any radiation unit 5 that is axially neighboring to the position of the low-frequency radiation unit 3 is 0.5 d.

To avoid mutual interference to signals between the low-frequency radiation units and the high-frequency radiation units, it is defined that all low-frequency radiation units with the position thereof being an odd number are the first low-frequency radiation units 2, and that all low-frequency radiation units with the position thereof being an even number are the second low-frequency radiation units 3. In this example, the first low-frequency radiation units 2 and the second low-frequency radiation units 3 have different structural forms, which are specifically reflected by different forms of their radiation arms. With respect to a first low-frequency radiation unit 2 with the position thereof being an odd number, due to the nesting with the high-frequency radiation unit 4, the radial size of the radiation arm of the high-frequency radiation unit 4 is usually smaller than the radial size of the radiation arm of the low-frequency radiation unit 2 on the orthographical projection plane. Therefore, the radiation arm of the first low-frequency radiation unit 2 may use a ring-shaped structure. In such a way, the radiation arm of the high-frequency radiation unit 4 and the radiation arm of the first low-frequency radiation unit 2 do not have an overlapping relationship on the orthographical projection plane, which avoids or reduces mutual interference of the signals. With respect to a second low-frequency radiation unit 3 with the position thereof being an even number, on the other hand, if the same structure of radiation arm as that of the first low-frequency radiation unit 2 is still employed, then the ring-shaped radiation arm will easily cross above the two high-frequency radiation units 5 adjacent to the first low-frequency radiation unit 2, thereby leading to mutual interference of the two's signals. Thus, the radiation arm of the second low-frequency radiation unit 3 preferably has a crossing shape, i.e. the above "cross" form of radiation arm structure. With its longitudinally elongated design of symmetric radiators, therefore, the phenomenon of overlapping with the high-frequency radiation units 5 on the orthographical projection plane can be avoided. With this means, it can ensure that signals of the low-frequency radiation column element and high-frequency radiation column element do not interfere with each other, or at least the degree of interference is minimized.

In all examples of the present invention, just like this example, the low-frequency radiation column element and high-frequency radiation column element are adapted to be within the above specified ranges of operating bands, the value of the first distance between neighboring low-frequency radiation units is limited to be in the range of 262.5-287.5 mm, and the value of the second distance between neighboring high-frequency radiation units is limited to be in the range of 105-115 mm. Alternatively, the first distance and the second distance may be determined in the following manner: the first distance of the low-frequency radiation column element is 0.6-1.0 times of the wavelength corresponding to the center frequency of the frequency band range in which the column element operates, preferably 0.8 times; similarly, the second distance of the high-frequency radiation column element is 0.6-1.0 times of the wavelength corresponding to the center frequency of the frequency band range in which the column element operates, preferably 0.8 times.

Please refer to FIG. 6. The multi-frequency array antenna according to Example 2 of the present invention is similarly a set of dual frequency common antenna, which, similarly to Example 1, comprises a low-frequency radiation column element and a high-frequency radiation column element, but the difference is that a part of the low-frequency radiation column element and a corresponding part of the high-frequency radiation column element are arranged to deviate from the imaginary first reference axis a. Specifically, it means that the second low-frequency radiation unit 3 and two high-frequency radiation units 5 adjacent axially thereto are no longer located on the first reference axis a, as other radiation units do, but are arranged to deviate from the first reference axis a, respectively: the adjacent two high-frequency radiation units 5 are fixedly arranged on an imaginary second reference axis (not shown) at one side of the first reference axis a, the second low-frequency radiation unit 3 is fixedly arranged on an imaginary third reference axis (not shown) at the other side of the first reference axis a, and both the second reference axis and the third reference axis are symmetric with respect to the first reference axis a and parallel to the first reference axis a. The improvement to this structure is favorable for flexible selection of the form of the radiation arm structure of the second low-frequency radiation unit, without causing concerns of signal interference with the adjacent two radiation units. In addition, this type of signal interference may theoretically be further reduced regardless of the selected form of the radiation arm structure.

It should be noted that the reason why the second reference axis and the third reference axis are imaginary but not shown is only for the purpose of description, which avoids misunderstanding by additional lines that radiation units on different reference axes are mistaken as a plurality of radiation units. The same reason applies below.

Please refer to the multi-frequency array antenna in Example 3 disclosed by FIG. 7, which makes improvements to Example 2. The improvements thereof are: wherein one of the second low-frequency radiation units 3 is arranged on an imaginary third reference axis (not shown), and two high-frequency radiation units adjacent axially thereto are similarly still located on the imaginary second reference axis (not shown). However, the other second low-frequency radiation unit 3 is arranged on the imaginary second reference axis (not shown). To adapt to this change, the two high-frequency radiation units 5 adjacent axially to the second low-frequency radiation unit 3 are moved to the third reference axis. This example is substantially equivalent to Example 2, which are mutually interchangeable solutions.

FIG. 8 further discloses the arraying solution of the multi-frequency array antenna according to Example 4 of the present invention, which performs transformation based on Example 1, and the only transformation is that all of the low-frequency radiation units employed by the low-frequency radiation column element thereof are the above second low-frequency radiation units, i.e. the form of the radiation arm structure is a "cross" shape. The unified structure form of the low-frequency radiation units is favorable for the standard execution in the production process, making the assembly more convenient and thereby improving the production efficiency.

Please refer to FIG. 9, FIG. 10 and FIG. 11, which disclose the multi-frequency array antenna according to Example 5, Example 6 and Example 7, respectively, and disclose the implementation form to apply the multi-frequency array antenna in 3, 4 and 5 frequency bands, respectively. Among them, the 3-frequency band common antenna shown in FIG. 9 is implemented based on the arraying solution in Example 1 and by providing another imaginary reference axis a2 parallel to the first reference axis a1 on the metal reflector, and arranging another high-frequency radiation column element on the reference axis a2 for processing signals in a third frequency band range; the 4-frequency band common antenna shown in FIG. 10 is implemented by providing two imaginary reference axes a1 and a2 on the metal reflector, and arranging a dual-frequency common antenna structure similar to Example 1 and operating in different frequency bands on the two reference axes a1 and a2, respectively; the 5-frequency band common antenna shown in FIG. 11 is implemented by providing three imaginary reference axes a1, a2 and a3 on the metal reflector, wherein the reference axis a1 is arranged with only one high-frequency radiation column element, while an arraying structure that is completely the same as Example 4 is employed on the other two reference axes a2 and a3 that are arranged symmetrically with respect to a1. It can be seen from the examples in FIG. 9 through FIG. 11 that the multi-frequency array antenna according to the present invention may achieve an antenna with two or more common frequency bands by flexibly adding a plurality of low-frequency radiation column elements and/or high-frequency radiation column elements and assigning identical or different ranges of operating frequency bands thereto.

The second distance arranged in the axial direction of the first reference axis a for the distance between high-frequency radiation units in the above examples may also be fine-tuned according to specific implementation situations and arranged to be close to an equal distance. Similarly, the first distance 2.5 d arranged in the axial direction of the first reference axis a for the distance between low-frequency radiation units may also be fine-tuned according to specific implementation situations and arranged to be close to an equal distance. All of those skilled in the art are aware of such variations. As a result, any solutions that achieve the same or similar technical effect as the present invention by fine-tuning values of the first distance and the second distance shall be deemed not departing from the spirit and essence of the present invention.

It should be noted that when the distance between high-frequency radiation units in the present invention is not an equal distance, the axial distance between low-frequency radiation units is not strictly 2.5 times, but changes to an equivalent relative position close to 2.5 times. Namely, the physical center of the low-frequency radiation unit that is not nested with high-frequency is located between two high-frequency radiation units locationally corresponding thereto. Those skilled in the art should be aware that according to their understanding of antenna technologies, such a variation is an equivalent alternative to the present invention, which similarly does not depart from the spirit and essence of the present invention.

All examples of the present invention achieve unanticipated effect and can realize compatibility with 2G, 3G and 4G signals. According to the current mobile communication systems 2G/3G/LTE, the frequency band range in which the low-frequency radiation column element operates may be 790-960 MHz and the frequency band range in which the high-frequency radiation column element operates may be 1700-2700 MHz, based on which the center frequencies of the high-frequency radiation column element and the low-frequency radiation column element are calculated to be f1=2200 MHz and f2=875 MHz, respectively. It can be seen that it exactly satisfies the relationship of f1/f2~2.5 times.

In summary, the according to the present invention optimally meets the current arraying need by super wide frequency common antennas, greatly improves the electrical performance of the antennas, and at the same time, realizes overall miniaturization of the antennas.

It should be noted that the above examples are only used to describe the present invention, rather than limit the technical solution described by the present invention; although the Specification has provided a detailed description of the present invention with reference to the above examples, therefore, those skilled in the art should understand that modifications or equivalent substitutions may still be made to the present invention; all technical solutions and improvements thereof that do not depart from the spirit and scope of the present invention shall be encompassed by the claims of the present invention.

The invention claimed is:

1. A multi-frequency array antenna, comprising: a metal reflector, a low-frequency radiation column element that is arranged on the metal reflector and operates in a first frequency band range, and a high-frequency radiation column element operating in a second frequency band range, wherein the low-frequency radiation column element comprising several low-frequency radiation units arranged at an equal first distance in the axial direction of a first reference axis, and the high-frequency radiation column element comprising several high-frequency radiation units arranged at an equal second distance in the axial direction of the first reference axis, characterized in that the first distance is 2.5 times of the second distance, at least one of the low-frequency radiation units is nested with one high-frequency radiation unit locationally corresponding thereto, and separately, at least one of the low-frequency radiation units is axially located between two neighboring high-frequency radiation units adjacent to the low-frequency radiation unit;

wherein for the mutually nested low-frequency radiation units and high-frequency radiation units, their own radiation arms are in a relationship of central symmetry, and when projected orthographically to the orthographical projection plane of the metal reflector, the two's symmetry centers are overlapped.

2. The multi-frequency array antenna according to claim 1, characterized in that each of the low-frequency radiation units with the axial positions on the first reference axis being an odd or even number is nested with one high-frequency radiation unit locationally corresponding thereto, and other low-frequency radiation units are scattered between two neighboring high-frequency radiation units axially adjacent to said low-frequency radiation units.

3. The multi-frequency array antenna according to claim 1, characterized in that both the low-frequency radiation units and the high-frequency radiation units comprise a radiation arm for radiating signals in their band ranges, and when projected orthographically to the orthographical projection plane of the metal reflector, there is no overlapping between all radiation arms of the low-frequency radiation units and radiation arms of the high-frequency radiation units.

4. The multi-frequency array antenna according to claim 1, characterized in that the low-frequency radiation column element comprises two types of low-frequency radiation units having different radiation arm structures, wherein the first low-frequency radiation unit and the second low-frequency radiation unit are located at the odd numbered and even numbered positions in said axial direction, respectively.

5. The multi-frequency array antenna according to claim 4, characterized in that when projected orthographically to the orthographical projection plane of the metal reflector, the radiation arm of the first low-frequency radiation unit is of any ring shape, including rectangular and circular.

6. The multi-frequency array antenna according to claim 4, characterized in that when projected orthographically to the orthographical projection plane of the metal reflector, the radiation arm of the second low-frequency radiation unit is of a crossing shape with an orthogonal relationship.

7. The multi-frequency array antenna according to claim 4, characterized in that the first low-frequency radiation unit and the high-frequency radiation unit nested therein are arranged at positions at one side of the reference axis.

8. The multi-frequency array antenna according to claim 4, characterized in that the second low-frequency radiation units are arranged at positions at one side of the reference axis.

9. The multi-frequency array antenna according to claim 1, characterized in that the first distance of the low-frequency radiation column element is 0.6-1.0 times of the wavelength corresponding to the center frequency of the first frequency band range.

10. The multi-frequency array antenna according to claim 9, characterized in that the first distance of the low-frequency radiation column element is 0.8 times of the wavelength corresponding to the center frequency of the first frequency band range.

11. The multi-frequency array antenna according to claim 1, characterized in that the second distance of the high-frequency radiation column element is 0.6-1.0 times of the wavelength corresponding to the center frequency of the second frequency band range.

12. The multi-frequency array antenna according to claim 11, characterized in that the second distance of the high-frequency radiation column element is 0.8 times of the wavelength corresponding to the center frequency of the second frequency band range.

13. The multi-frequency array antenna according to claim 1, characterized in that the first frequency band range in which the low-frequency radiation column element operates is 790-960 MHz; and the second frequency band range in which the high-frequency radiation column element operates is 1700-2700 MHz.

14. The multi-frequency array antenna according to claim 1, characterized in that the value of the first distance is in the range of 262.5-287.5 mm, and the value of the second distance is in the range of 105-115 mm, both of which are inclusive.

15. The multi-frequency array antenna according to claim 1, characterized in that the low-frequency radiation units and the high-frequency radiation units are all arranged on the first reference axis.

16. The multi-frequency array antenna according to claim 1, characterized in that at least one of the low-frequency radiation units axially arranged between two neighboring high-frequency radiation units is fixed on a second reference axis, while the two high-frequency radiation units adjacent thereto are fixed on a third reference axis, and the second reference axis and the third reference axis are symmetric with respect to and parallel to the first reference axis.

17. The multi-frequency array antenna according to claim 16, characterized in that another low-frequency radiation units axially arranged between two neighboring high-frequency radiation units is fixed on the third reference axis, while the two high-frequency radiation units adjacent thereto are fixed on the second reference axis.

* * * * *